US005505750A

United States Patent [19]

Andrews

[11] Patent Number: 5,505,750

[45] Date of Patent: Apr. 9, 1996

[54] INFILTRANT FOR METAL BONDED ABRASIVE ARTICLES

[75] Inventor: Richard M. Andrews, Westborough, Mass.

[73] Assignee: Norton Company, Worcester, Mass.

[21] Appl. No.: 263,962

[22] Filed: Jun. 22, 1994

[51] Int. Cl.[6] ..... B24D 3/08

[52] U.S. Cl. ..... 51/309; 51/307; 451/125

[58] Field of Search ..... 51/293, 295, 309; 451/125

[56] References Cited

U.S. PATENT DOCUMENTS 4,977,710 12/1990 Une ..... 51/309
5,178,643 1/1993 Schimweg ..... 51/309
5,232,469 8/1993 McEachron et al. ..... 51/309
5,385,591 1/1995 Ramanath et al. ..... 51/309
5,453,105 9/1995 Middlemiss et al. ..... 51/309

*Primary Examiner*—Deborah Jones
*Attorney, Agent, or Firm*—Brian M. Kolkowski

[57] ABSTRACT

The present invention is an abrasive tool comprising abrasive particles, hard phase particles and a metal bond, wherein the metal bond comprises a near-eutectic copper phosphorus composition. The present invention further includes an abrasive tool comprising a metallic core; and an abrasive composition bonded to the metallic core; wherein the abrasive composition comprises abrasive particles, hard phase particles and a metal bond, and wherein the metal bond comprises a near-eutectic copper-phosphorus composition. The invention further includes a process of manufacturing the above abrasive tool.

16 Claims, 1 Drawing Sheet

INFILTRANT FOR METAL BONDED ABRASIVE ARTICLES

BACKGROUND OF THE INVENTION

1. Field of the Invention

The invention relates to abrasive tools containing a non-volatile, low temperature and relatively hard metal matrix. The invention further includes a improved process for manufacturing abrasive wheels with a non-volatile, low temperature and relatively hard metal matrix.

2. Technology Review

Diamond dressers or dressing wheels are used for reconditioning the surfaces of grinding wheels. Metal bonded diamond dressers are generally bonded by zinc containing alloys, copper-silver alloys or by pure copper itself.

Zinc containing alloys which are used in manufacturing metal bonded diamond dressers have several drawbacks. Zinc is excessively volatile during the infiltration process resulting in the zinc boiling off. This reduces the zinc content and raises the liquidus temperature of the metal resulting in higher infiltration temperatures. This further leads to premature furnace lining failure, higher energy costs and potential environmental liabilities since zinc and its oxide are considered hazardous by the EPA and OSHA.

Manufacturers get around using zinc containing alloys by using either a pure copper infiltrant, or by using copper-silver alloys. Pure copper, however, again requires higher temperatures (approximately 1090° C.) which risks damage to the diamonds used as the abrasive, while the copper-silver alloys are exceedingly expensive, and rather soft.

An object of this invention is to produce a metal bonded dresser which uses a metal bond which is relatively non-volatile, can be infiltrated at lower temperatures, is inexpensive and is relatively hard.

A further object of this invention is to develop a process utilizing this metal bond.

SUMMARY OF THE INVENTION

The present invention is an abrasive tool comprising abrasive and hard phase particles wherein the abrasive and hard phase particles are bonded together by a metal bond comprising a near-eutectic copper phosphorus composition. The present invention further includes an abrasive tool comprising a metallic core; and an abrasive composition bonded to the metallic core; wherein the abrasive composition comprises abrasive particles, hard phase particles and a metal bond, and wherein the metal bond comprises a near-eutectic copper phosphorus composition. The invention further includes a process of manufacturing the above abrasive tool.

DETAILED DESCRIPTION OF THE INVENTION

Figure 1:
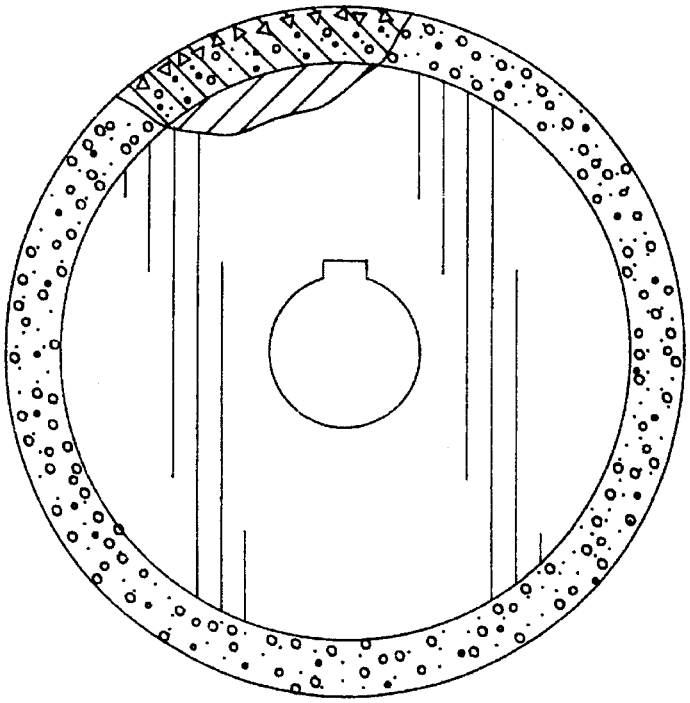
FIG. 1 Side view, partially in section of a roll dressing wheel.

The present invention is an abrasive tool comprising abrasive and hard phase particles wherein the abrasive and hard phase particles are bonded together by a metal bond comprising a near-eutectic copper phosphorus composition.

The present invention further includes an abrasive tool comprising a metallic core; and an abrasive composition bonded to the metallic core; wherein the abrasive composition comprises abrasive particles, hard phase particles and a metal bond, and wherein the metal bond comprises a near-eutectic copper phosphorus composition. The invention further includes a process of manufacturing the above abrasive tool.

The abrasive tool formed is preferably an abrasive dressing wheel which is used for maintaining the free cutting condition of and for cutting a form into a grinding wheel. The abrasive tool preferably has a metallic core to which an abrasive composition is bonded. The metallic core can for example be formed from steel preferably solid plain carbon or stainless steel, or from infiltrated powdered metal where the metal bond used as the infiltrant is the same as the metal bond in the abrasive composition, and the powdered metal can be for example tungsten, iron, steel, cobalt or combinations thereof.

The abrasive composition which can be bonded to the metallic core or formed by itself comprises abrasive particles, hard phase particles and a metal bond. The abrasive particles which may be used include for example diamond, cubic boron nitride, boron suboxide, sol-gel aluminas, fused alumina, silicon carbide, flint, garnet and bubble alumina. The preferred abrasive particles used are abrasives which are generally considered as superabrasives because of their physical characteristics which include for example diamond, cubic boron nitride and boron suboxide. The more preferred abrasive particles used are diamond. Secondary abrasives which include one or more of those types of abrasive particles listed above may be used.

The hard phase particles which may be used include for example tungsten, tungsten carbide, cobalt, steel, sol-gel aluminas, stellite and combinations thereof. The hard phase particles are included into the metal bond around the abrasives, preferably diamond, to control the wear resistance of the tool. The hard phase thus reduces the erosive wear rate of the bond thereby allowing the metal to hold the abrasive longer.

The abrasive composition includes a metal bond. The metal bond used preferably is a metal bond which can be infiltrated below about 925° C., more preferably below about 875° C. and most preferably below about 825° C. The metal bond preferably has a Rockwell B hardness of greater than 50, more preferably greater than 60 and most preferably greater than 70.

A copper-silicon based composition can be used for the metal bond, however, the preferred metal bond is a copper phosphorus based composition. The metal bond composition has to be near-eutectic to benefit from a narrow melting range, i.e., the liquidus and solidus are close together. Once such an alloy melts, it flows into the packed abrasive and packed hard phase particles with its nominal composition. This is because an alloy with a wide melting range will tend to segregate as the temperature rises. The lower melting point portion will start to flow shortly after the solidus is reached leaving the remaining metal bond behind. The net result is that the product would have a different composition of metal bond in different parts of the piece which is undesirable. Further some portions of the metal bond may also never melt leaving a skin or crust on the part which must be removed. A eutectic composition also has the advantage of having the lowest possible melting point thereby minimizing processing costs.

Preferably, the copper comprises from about 65 to about 94 weight percent of the total weight of the metal bond, and the phosphorus comprises from about 6 to about 35 weight percent of the total weight of the metal bond. More preferably, the copper comprises from about 65 to about 73 weight percent of the total weight of the metal bond, and the phosphorus comprises from about 27 to about 35 weight percent of the total weight of the metal bond. Most preferably the copper comprises from about 91 to about 94 weight percent of the total weight of the metal bond, and the phosphorus comprises from about 6 to about 9 weight percent of the total weight of the metal bond.

The abrasive tool can be formed by techniques known to those skilled in the art. One method is by mixing abrasive and hard phase particles with small amounts of lubricant. This mixture is then pressed into a mold with a cavity of the shape of the final abrasive tool. A measured amount of metal bond preferably a near-eutectic copper-phosphorus alloy is then placed above the mixture in the mold, preferably in the form of slugs. The mold is heated under reducing conditions causing infiltration of the metal bond into the abrasive-hard phase mixture.

Another method of forming the abrasive tool is by setting and orienting the abrasive with adhesive or some other suitable substance to the inside surface or cavity of the mold with the shape of the final abrasive tool. Hard phase particles are then mixed with small amounts of lubricant and are pressed into the mold. A measured amount of metal bond preferably a near-eutectic copper-phosphorus alloy is then placed above the mixture in the mold, preferably in the form of slugs. The mold is then heated under reducing conditions causing infiltration of the metal bond into the abrasive and hard phase. Other variations or combinations are apparent to and can readily be made by those skilled in the art without departing from the scope and spirit of this invention.

DETAILED DESCRIPTION OF THE INVENTION

Figure 2:
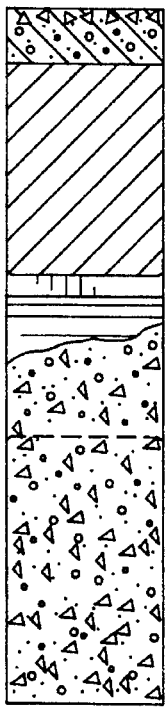
FIG. 2 Front view, partially in section of a roll dressing wheel.

Referring now to the drawings in detail. FIGS. 1 and 2 illustrate a roll dressing tool used for dressing a grinding wheel. The dressing tool is designed in the preferred embodiment as a roll dressing wheel 10. The roll dressing wheel 10 is provided with a core 20 in which there exists a bore 30 and to which is bonded an abrasive composition 40.

Individual diamond abrasive grains 41 are spaced around the periphery of the roll dressing wheel 10 and are preferably spaced and/or oriented. The diamond abrasive grains 41 are held and bonded to the core 20 by a metal bond containing hard phase particles 42. The metal bond is preferably a near-eutectic copper-phosphorus composition.

The preferred method of forming the abrasive tool is by setting and orienting diamonds with adhesive or some other suitable substance to the inside surface or cavity of the mold with the shape of the final abrasive tool. A mixture of hard metal and secondary abrasive with a few percent wax for lubrication is hand-pressed around the diamonds. A steel core is centered in the cavity of the mold and tungsten powder is then poured into the annular space between the core and the diamond/hard phase layer. A measured amount of metal bond, preferably being a near-eutectic copper-phosphorus alloy, is then placed above the mixture and powder in the mold, preferably in the form of slugs. The mold is heated under reducing conditions causing infiltration of the metal bond into the diamond, the hard phase/secondary abrasive mixture and the tungsten powder.

It is understood that various other modifications will be apparent to and can be readily made by those skilled in the art without departing from the scope and spirit of the present invention. Accordingly, it is not intended that the scope of the claims appended hereto be limited to the description set forth above but rather that the claims be construed as encompassing all of the features of patentable novelty which reside in the present invention, including all features which would be treated as equivalents thereof by those skilled in the art to which the invention pertains.

What is claimed is:

1. An abrasive tool comprising:

abrasive and hard phase particles wherein the abrasive and hard phase particles are bonded by a metal bond comprising a near-eutectic copper-phosphorus composition.

2. The abrasive tool in claim 1, wherein the abrasive particles are diamond.

3. The abrasive tool in claim 1, wherein the hard phase particles are selected from a group consisting of W, Co, and alloys thereof, WC, steel, sol-gel alumina, and combinations thereof.

4. The abrasive tool in claim 1, wherein the abrasive tool is a metal bonded dressing tool.

5. The abrasive tool in claim 1, wherein the near-eutectic copper-phosphorus composition is from about 65 to about 94 percent by weight copper, and from about 6 to about 35 percent phosphorus.

6. An abrasive tool comprising:

a metallic core; and an abrasive composition bonded to the metallic core;

wherein the abrasive composition comprises abrasive particles, hard phase particles and a metal bond, and wherein the metal bond comprises a near-eutectic copper-phosphorus composition.

7. The abrasive tool in claim 6, wherein the abrasive particles are diamond.

8. The abrasive tool in claim 6, wherein the hard phase particles are selected from a group consisting of W, Co, and alloys thereof, WC, steel, sol-gel alumina, and combinations thereof.

9. The abrasive tool in claim 6, wherein the abrasive tool is a metal bonded dressing tool.

10. The abrasive tool in claim 6, wherein the near-eutectic copper-phosphorus composition is from about 65 to about 94 percent by weight copper, and from about 6 to about 35 percent phosphorus.

11. The abrasive tool in claim 6, wherein the metallic core is steel.

12. A process for producing a metal bonded abrasive tool comprising:

filling a mold with abrasive particles and hard phase particles;

infiltrating both the abrasive particles and the hard phase particles with metal bond comprising a near eutectic copper phosphorus composition.

13. The process in claim 12, wherein the abrasive particles are diamond.

14. The process in claim 12, wherein the hard phase particles are selected from a group consisting of W, CO, and alloys thereof, WC, steel, sol-gel alumina, and combinations thereof.

15. The process in claim 12, wherein the abrasive tool is a metal bonded dressing tool.

16. The process in claim 12, wherein the near-eutectic copper-phosphorus composition is from about 65 to about 94 percent by weight copper, and from about 6 to about 35 percent phosphorus.

* * * * *